US009469460B2

(12) United States Patent
Billen

(10) Patent No.: US 9,469,460 B2
(45) Date of Patent: Oct. 18, 2016

(54) VEHICLE REPLICA CARTON AND METHOD OF FORMING THE SAME

(71) Applicant: Kid Stuff Marketing, Inc., Topeka, KS (US)

(72) Inventor: William D. Billen, Topeka, KS (US)

(73) Assignee: Kid Stuff Marketing, Inc., Topeka, KS (US)

( * ) Notice: Subject to any disclaimer, the term of this patent is extended or adjusted under 35 U.S.C. 154(b) by 0 days.

(21) Appl. No.: 14/716,506

(22) Filed: May 19, 2015

(65) Prior Publication Data

US 2015/0329269 A1 Nov. 19, 2015

Related U.S. Application Data

(60) Provisional application No. 62/000,330, filed on May 19, 2014.

(51) Int. Cl.
*B65D 81/36* (2006.01)
*A63H 33/16* (2006.01)
*B65D 5/42* (2006.01)

(52) U.S. Cl.
CPC ..... *B65D 81/368* (2013.01); *B65D 5/425* (2013.01); *B65D 5/4266* (2013.01)

(58) Field of Classification Search
CPC .. B65D 5/425; B65D 5/4266; B65D 81/368; B65D 81/365; A63H 33/16
See application file for complete search history.

(56) References Cited

U.S. PATENT DOCUMENTS 654,219 A * 7/1900 Bender, Jr. ..... A63H 33/00 229/104
979,812 A 12/1910 Warren
1,330,654 A 2/1920 Alexander
1,547,176 A 7/1925 Lazaron
1,553,793 A 9/1925 Rozowsky
2,118,821 A 5/1938 Ringler
2,679,395 A * 5/1954 Green ..... A63H 33/16 446/26
2,823,844 A 2/1958 Frankenstein
3,224,660 A 12/1965 Willis
4,055,250 A 10/1977 Mayhew
4,643,349 A 2/1987 Sheffer
4,646,959 A 3/1987 Sheffer
4,661,082 A 4/1987 Sheffer
4,804,133 A 2/1989 Kiyokane
5,454,508 A 10/1995 Billen
5,622,256 A 4/1997 Tesar
6,095,408 A * 8/2000 Nguyen ..... B65D 5/2009 229/120.21

(Continued)

FOREIGN PATENT DOCUMENTS

CH 295110 A * 2/1954 ..... A63H 33/16

*Primary Examiner* — Gary Elkins
(74) *Attorney, Agent, or Firm* — Erickson Kernell IP, LLC

(57) ABSTRACT

A method of forming a carton or container for food or other items having a model vehicle configuration is provided that accurately depicts the contours and dimensions of the vehicle to enhance its appeal. An elongated, cardboard-like sheet is presented that is die cut to fold into a three dimensional model of the vehicle. The sheet's first end is folded along a first pair of transverse fold lines and secured in a position to present an open cabin, rear deck and tail of the vehicle, whereby the open cabin may provide the container for food and other items. The sheet's central portion is folded upwardly along a pair of longitudinal fold lines to present the sides of the vehicle, and the second end portion is folded along a second pair of transverse fold lines and secured in position to present the hood and front windshield of the vehicle.

26 Claims, 14 Drawing Sheets

(56) References Cited

U.S. PATENT DOCUMENTS

| | | | | |
|---|---|---|---|---|
| D547,396 | S | 7/2007 | Yaguchi | |
| 7,317,573 | B2 | 1/2008 | Billen | |
| 7,487,903 | B2 | 2/2009 | Billen | |
| 7,654,441 | B2 | 2/2010 | Billen | |
| 8,511,537 | B2 | 8/2013 | Billen | |
| 8,783,548 | B2 * | 7/2014 | Billen | B65D 5/425 229/116.4 |
| 8,979,608 | B2 * | 3/2015 | Hawthorne | A63H 33/04 446/109 |

* cited by examiner

VEHICLE REPLICA CARTON AND METHOD OF FORMING THE SAME

CROSS-REFERENCE TO RELATED APPLICATION

This application claims the benefit of application Ser. No. 62/000,330, filed on May 19, 2014, entitled VEHICLE REPLICA CARTON AND METHOD OF FORMING THE SAME.

FIELD

The present invention relates to cartons or trays which are formed from a sheet of cardboard-like material and have a model vehicle configuration for the enjoyment and amusement of the user.

BACKGROUND

Disposable cardboard trays and cartons for holding food items have been used by restaurants and theaters as a convenience for their customers and in particular, to organize and hold food for children and create additional interest by designs that are displayed on the tray or carton. When intended as a promotional device, it is desirable for a cardboard model to be easily and quickly constructed preferably from a die cut cardboard sheet by folding various panels and tabs along score lines in the material into an assembled shape. Particularly with respect to young children, printed material on the carton adds to the child's interest. Advantages of a one sheet, i.e., one-piece unit, include factors such as lower cost, easier printing of the model design or artwork on the cardboard, compact shipping, and ease and quickness in construction; however, the one-piece system can also make it very difficult to realistically replicate the contours and features of certain designated objects, such as modern cars.

SUMMARY

In an embodiment of the present invention a method of forming a carton having a model vehicle configuration is provided by a cardboard-like sheet having a first end portion that presents the cabin, rear deck and rear of the vehicle, a central portion that presents the bottom and sides of the vehicle and a second end portion that presents the hood and front windshield of the vehicle, with the first end portion including a pair of substantially parallel longitudinal fold lines defining first and second side segments of the vehicle and having a first pair of substantially parallel transverse fold lines between the first end portion and the central portion and a second pair of substantially parallel transverse fold lines between the second end portion and the central portion. The first end portion is folded along the first pair of transverse fold lines and secured in a position to present an open cabin, rear deck and rear of the vehicle, whereby the open cabin may provide the container for food and other items. The central portion is folded upwardly along the pair of longitudinal fold lines to present the sides of the vehicle, and the second end portion is folded along the second pair of transverse fold lines and secured in a position to present the hood and front windshield of the vehicle.

Other advantages of this carton assembly and method of making the same will become apparent from the following description taken in connection with the accompanying drawings, wherein is set forth by way of illustration and example an embodiment of the present invention.

DETAILED DESCRIPTION

Figure 1:
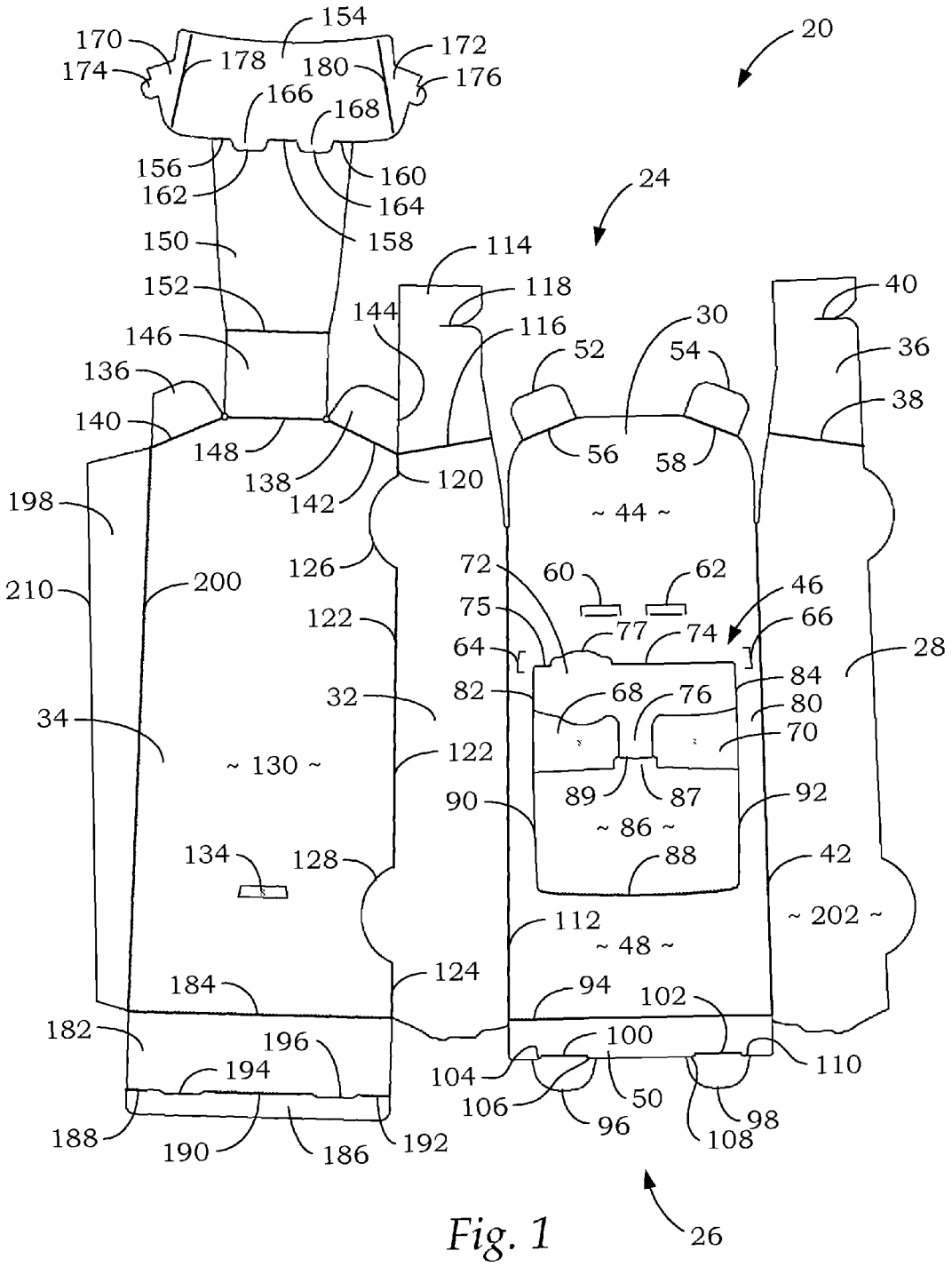
FIG. 1 is a top plan view of a piece of flat sheet material having fold and perforation lines thereon, from which a carton or tray is formed in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology may be used in the following description for convenience in reference only and will not be limiting. For example, the words "upwardly," "downwardly," "rightwardly," "leftwardly," "upper," "lower," "forwardly," "reawardly," "front," "rear," "top," "bottom," "inwardly" and "outwardly," etc., may refer to an installed position (as shown in the drawings) of the item to which the reference is made, or may refer to directions toward and away from, the geometric center of the embodiment being described and designated parts thereof. Said terminology may include the words specifically mentioned, derivatives thereof and words of a similar import. Similarly, the words "or" and "and" are not limiting and may mean "either," "one or the other," or "both."

Figure 11:
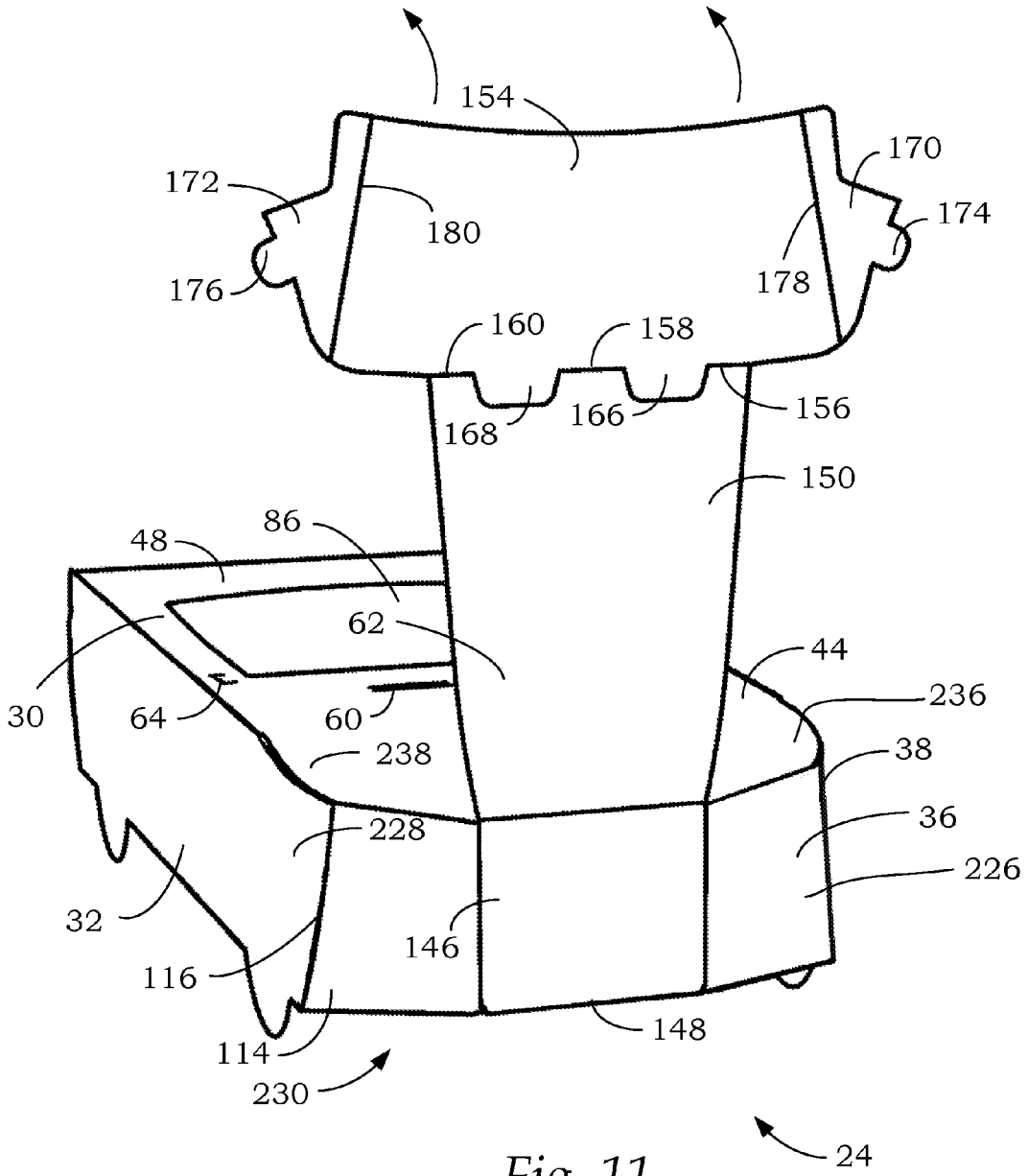
FIG. 11 is the front perspective view of FIG. 10, with the grill panel folded upwardly over the first and second side tabs.
Figure 12:
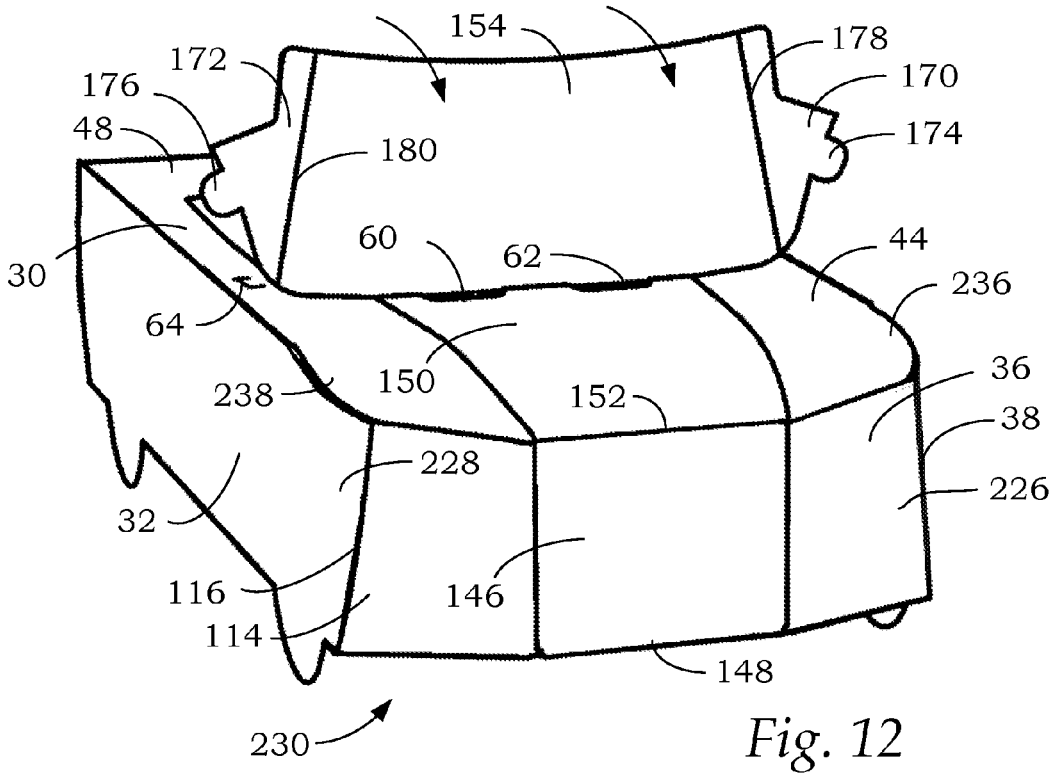
FIG. 12 is the front perspective view of FIG. 11, with the upper hood panel folded over the lower front hood panel and upper hood panel tabs engaging lower front hood panel slots to secure the upper hood panel in place.
Figure 13:
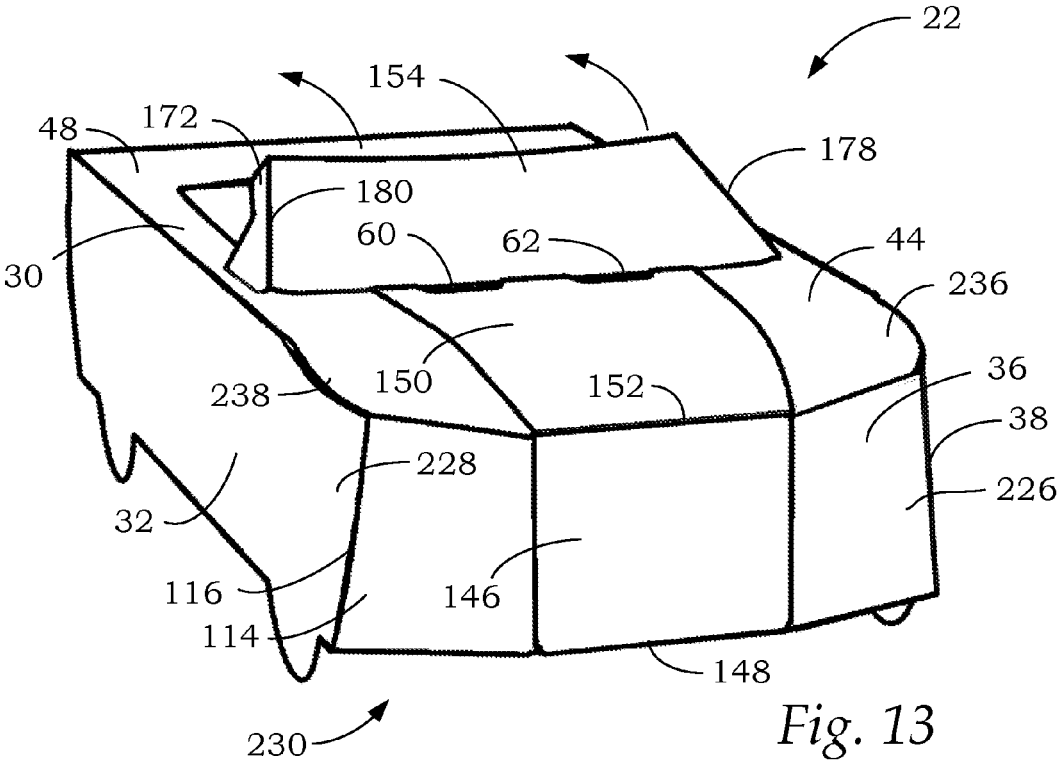
FIG. 13 is the front perspective view of FIG. 12, with the first and second wing tabs of the windshield engaging tabs in the upper panel to windshield panel in place.

Referring initially to FIGS. 1-13, a sequence of steps is illustrated and shows a flat piece of sheet material 20 (FIG. 1) which, after the assembly operation is complete, becomes an assembled vehicle 22 (FIG. 11). As shown and described herein, the vehicle 22 takes the form of a modern vehicle car but could take any desired form. The sheet 20 is paperboard or a similar semi-rigid material capable of retaining fold lines and die cut so that tabs and openings are formed upon removal of the cutout portions. A suitable material is 18-point white C1S SBS stock or a thin plastic material capable of retaining fold lines and being folded to a desired configuration. As is evident from FIG. 1, in its initially unassembled state, the sheet 20 is planar and flat having a first or front end 24 and a second or rear end 26.

FIG. 1 shows that the sheet 20 has a number of fold lines and perforation lines therein, the purpose of which will be described below. Additionally, the sheet stock from which the vehicle 22 is formed is die cut to provide the perimeter configuration shown. The sheet 20 includes a first side panel 28, an upper panel 30, a second side panel 32, and a bottom panel 34. The first side panel 28 includes a first side tab 36 extending forwardly from the first side panel 28 separated by fold line 38. The first side tab 36 includes an engaging slit 40.

The first side panel 28 transitions to upper panel 30 along fold line 42. Upper panel 30 includes a lower hood panel 44, an interior portion or cabin 46, a rear deck panel 48, and an upper rear flap 50. The lower hood panel 44 includes first 52 and second 54 lower hood tabs extending forwardly from lower hood panel 44 along fold lines 56 and 58, respectively, and first and second hood retaining slots 60 and 62, respectively, which are cut generally parallel to the front 24 of the vehicle 22. First 64 and second 66 windshield slots are cut generally parallel to the fold line 42 on opposite sides of the upper panel 30 generally at the transition between the lower hood panel 44 and the interior portion 46.

The interior portion 46 of upper panel 30 includes first and second cutouts 68 and 70, a dash panel 72, which extends from the rear of lower hood panel 44 along fold line 74. Dash panel 74 includes a console 76 extending rearwardly from the dash panel 72 when the dash panel 72 is not folded, and extending downwardly from the dash panel 72 when the dash panel is folded along fold lines 74 and 75 and separates from lower hood panel along die cut 77 to form the front interior of the vehicle 22. The dash panel 72 is free from interior panel first 78 and second 80 upper sides along die cuts 82 and 84.

An interior portion rear panel 86 extends forwardly from the rear deck panel 48 along fold line 88, and is free from interior panel first 78 and second 80 upper sides along die cuts 90 and 92. The interior portion rear panel 86 includes a tab 87 extending forwardly and separated from tab 76 extending rearwardly from the dash panel 76 by die cut 89. When the dash panel 72 and interior portion rear panel 86 are folded downwardly and inwardly to the interior section, a cabin of the vehicle is presented.

The upper rear flap 50 extends rearwardly from the rear deck panel 48 along fold line 94. A first 96 and second 98 tab extends rearwardly from rear flap 50 along fold lines 100 and 102 respectively. First tab 96 is die cut on opposite sides 104 and 106 as is second tab 98 on opposite sides 108 and 110, which presents wings on opposite sides of the tabs 96 and 98 to help lock the tabs 96 and 98 into their respective engaging slots disclosed herein below.

The upper panel 30 transitions to the second side panel 32 along fold line 112. The second side panel 32 includes a second side tab extending forwardly from the second side panel 32 separated by fold line 116. The second side tab 114 includes an engaging slit 118 for engaging and locking to the engaging slit 40 of the first side tab 36.

The second side panel 32 transitions to the bottom panel 34 along fold lines 120, 122 and 124, and die cut second front wheel 126 and second rear wheel 128. The bottom panel 34 includes a base panel 130 with a first cutout 134 for receiving the tab 87 of interior portion rear panel 86, which secures the interior portion rear panel 86 is folded along fold line 88 into the interior space and in place.

The bottom panel 34 includes first 136 and second 138 front tabs, which transition along fold lines 140 and 142, respectfully from bottom panel 34 at the front end 24. Second front tab 138 is separated from second side tab 114 along die cut 144. A grill panel 146 transitions along fold line 148 from base panel 130 to an upper hood panel 150 along fold line 152. A windshield panel 154 extends from upper hood panel 150 along fold lines 156, 158 and 160, and dies cut lines 162 and 164, which form first 166 and second 168 hood retention tabs. The windshield panel 154 includes first 170 and second 172 wings which each include a tab 174 and 176, respectively, for engaging slots 64 and 66, respectively, to secure the windshield panel 154 in position to the upper panel 30. The first wing 170 extends from the windshield panel 154 along fold line 178, and the second wing 172 extends from the windshield panel 154 along fold line 180.

A lower rear panel 182 transitions from base panel 130 along fold line 184. The lower rear panel 182 transitions to a lower rear flap 186 along fold lines 188, 190 and 192, and die cuts 194 and 196 presenting slots for receiving tabs 96 and 98. An adhesive tab 198 extends from base panel 130 along fold line 200.

Figure 2A:
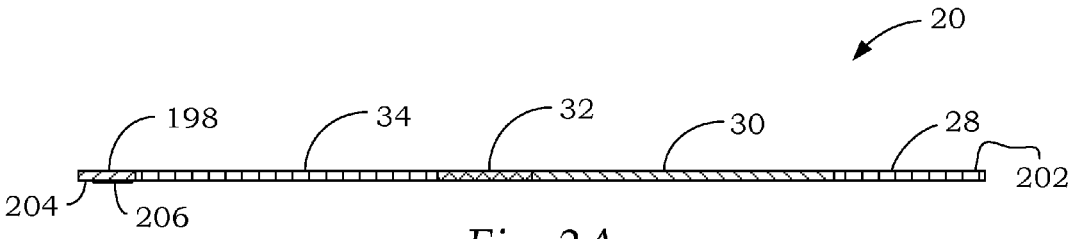
FIGS. 2A-2F are diagrammatic illustrations of the folding of the flat sheet of FIG. 1 to form the rectangular configuration shown in FIG. 4.
Figure 2B:
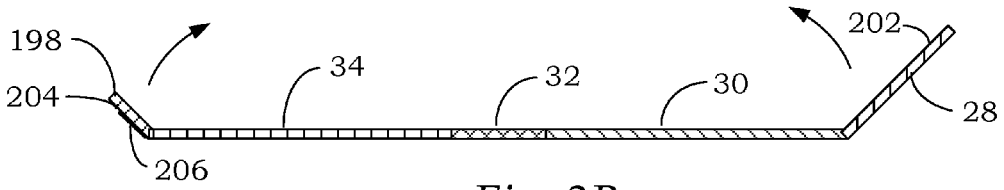
Figure 2C:
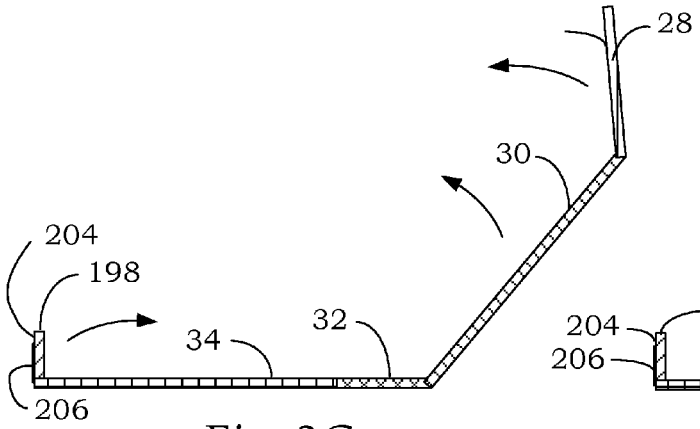
Figure 2D:
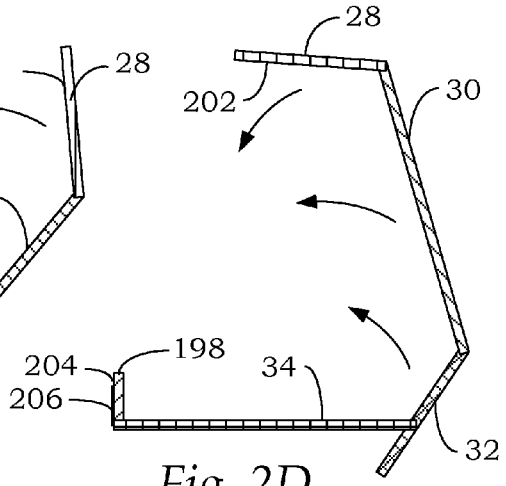
Figure 2E:
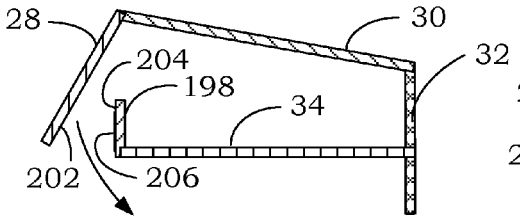
Figure 2F:
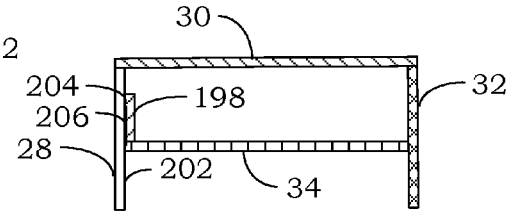

Referring to FIGS. 2A-2F, a folding sequence is shown to illustrate a method to achieve a rectangular intermediate configuration of the completed vehicle 22. The panels of sheet 20 are not to scale in thickness or width, and are presented to illustrate the folding method. From the flat sheet 20 configuration (FIG. 2A), the adhesive tab 198 is folded along fold line upwardly and inwardly. First side panel 28 is folded along fold line 42 upwardly and inwardly toward adhesive tab 198 (FIG. 2B). Next, upper panel 30 is folded along fold line 112 upwardly and inwardly toward adhesive tab 198 as first side panel 28 is continued to be folded inwardly (FIG. 2C). Next, second side panel 32 is folded along fold lines 120, 122 and 124 and separates from bottom panel 34 along die cuts 126 and 128 (FIG. 2D). Next, folding of the second side panel 32 is completed as it is generally perpendicular to the bottom panel 34, while the upper panel 30 and first side panel 28 are continued to be folded (FIG. 2E). Finally, the upper panel 30 is folded generally perpendicular to the second side panel 32 and generally parallel to the bottom panel 34, while the first side panel 28 is folded generally perpendicular to the upper panel 30 and over the adhesive tab 198 (FIG. 2F). An inside surface 202 of the first side panel 28 is secured to an outside surface 204 of the adhesive tab 198 with an adhesive 206 or other fastening method such as double sticky tape, tape, glue, or mechanical fasteners, for example, to complete the rectangular configuration 208 of the vehicle 22.

Figure 3A:
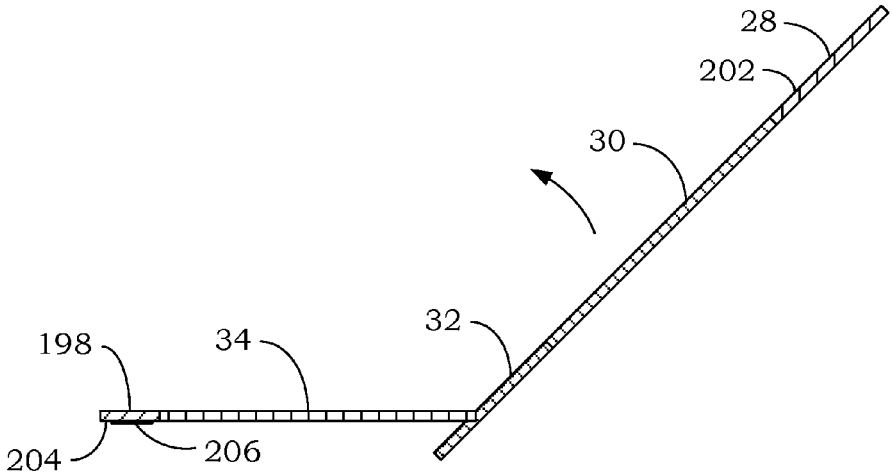
FIGS. 3A-3I are diagrammatic illustrations of the folding of the flat sheet of FIG. 1 to form an intermediate flat collapsed configuration and the final rectangular configuration shown in FIG. 4.
Figure 3B:
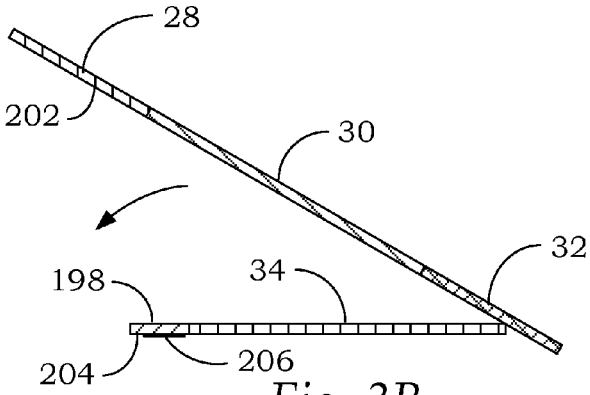
Figure 3C:
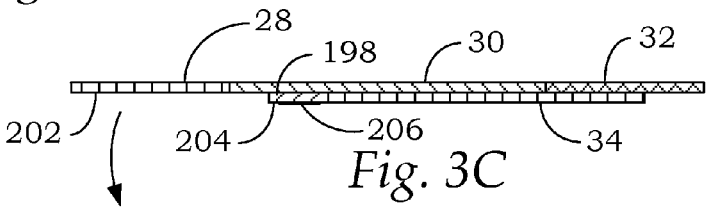
Figure 3D:
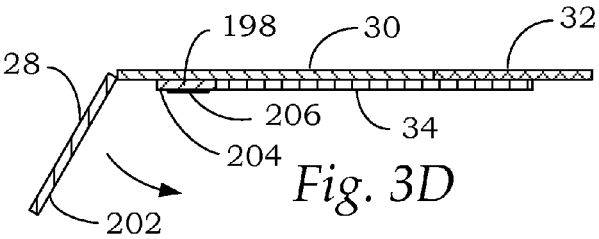
Figure 3E:
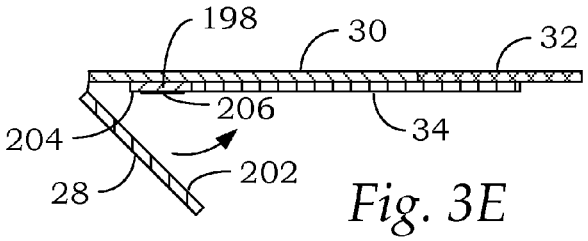
Figure 3F:
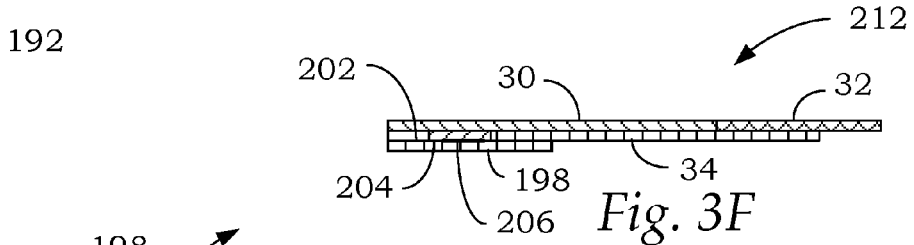
Figure 3G:
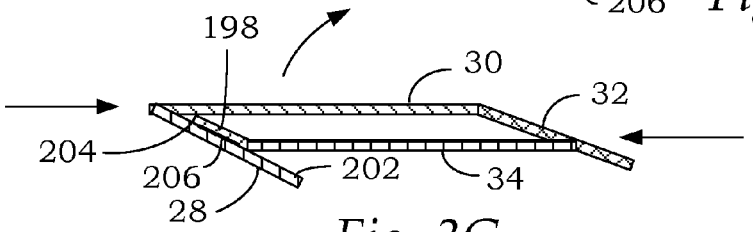
Figure 3H:
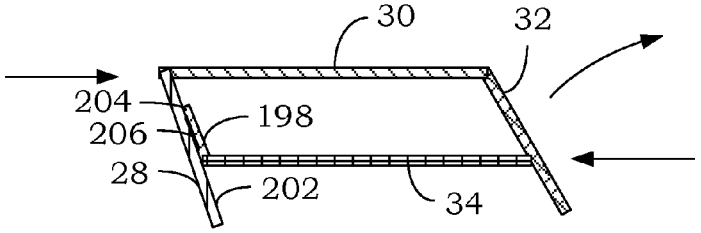
Figure 3I:
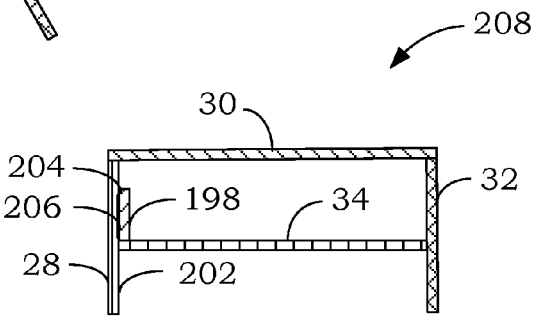

Referring to FIGS. 3A-3I, an alternative folding sequence is shown to illustrate a method to achieve a rectangular intermediate configuration of the completed vehicle 22. The panels of sheet 20 are not to scale in thickness or width, and are presented to illustrate the folding method. From the flat sheet 20 configuration (FIG. 2A), the first side panel 28, upper panel 30 and second side panel 32 are folded upwardly together along fold lines 120, 122 and 124 and with second side panel 32 separating from bottom panel 34 along die cuts 126 and 128 (FIG. 3A). Next, first side panel 28, upper panel 30 and second side panel 32 are continued to be folded along fold lines 120, 122 and 124 (FIG. 3B) until folded flat over bottom panel 34 and adhesive tab 198 (FIG. 3C). Next, first side panel 28 is folded downwardly along fold line 42 (FIG. 3D). The first side panel 28 is folded around the edge 210 of the adhesive tab 198 (FIG. 3E) until folded flat over the outside surface 204 of the adhesive tab 198 (FIG. 3F). The inside surface 202 of the first side panel 28 is secured to the outside surface 204 of the adhesive tab 198 with an adhesive 206 or other fastening method such as double sticky tape, tape, glue, or mechanical fasteners, for example, to present a flat collapsed configuration 212 of the vehicle 22. Next, the flat collapsed configuration 212 is opened by applying a first force to the fold line 42 and second force opposite the first force to the fold line 122 to open the flat collapsed configuration 212 (FIGS. 3G and 3H), until the rectangular configuration 208 of the vehicle 22 is achieved (FIG. 3I).

Figure 4:
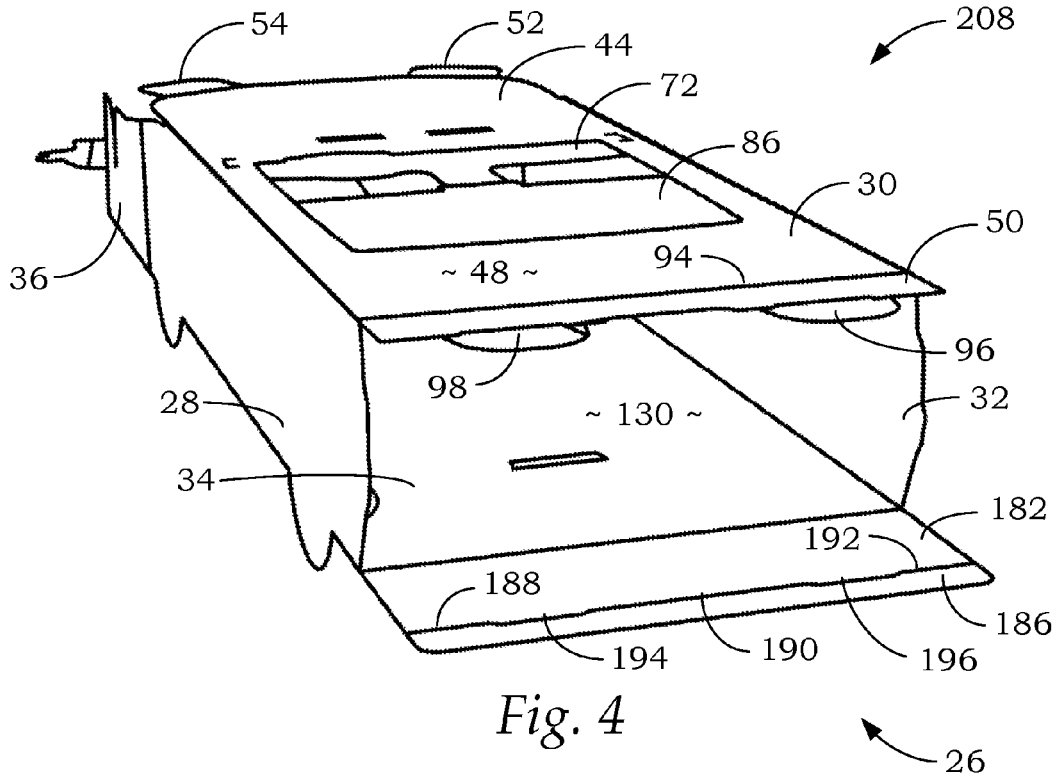
FIG. 4 is a rear perspective view of the sheet material of FIG. 2F or 3I, with a first side folded over and secured to an adhesive tab portion thereof.
Figure 5:
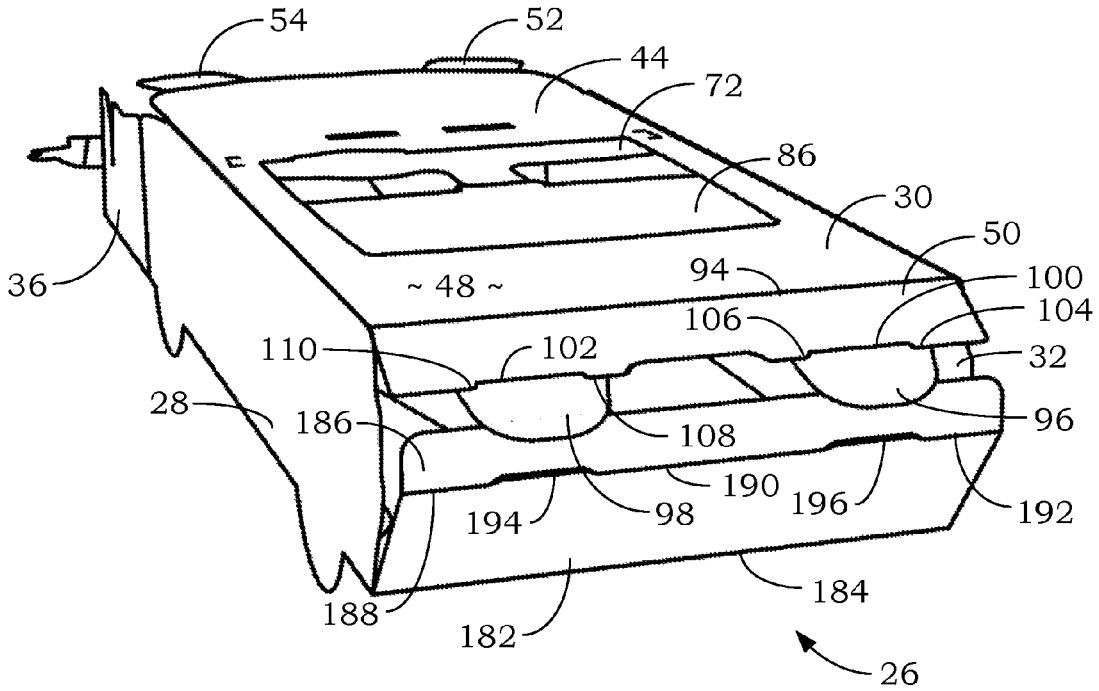
FIG. 5 is the rear perspective view of FIG. 4, with a lower rear flap folded upwardly and an upper rear flap folded downwardly.
Figure 6:
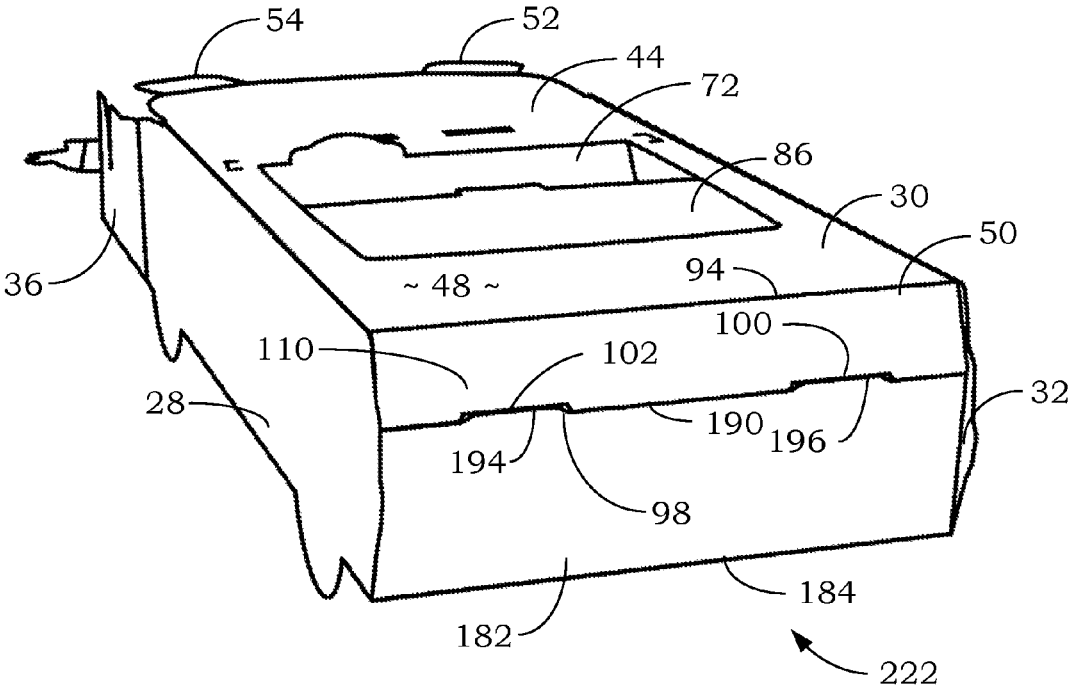
FIG. 6 is the rear perspective view of FIG. 5, with the tabs of the upper rear flap engaging the slots of the lower rear flap enclosing the rear of the vehicle.
Figure 7:
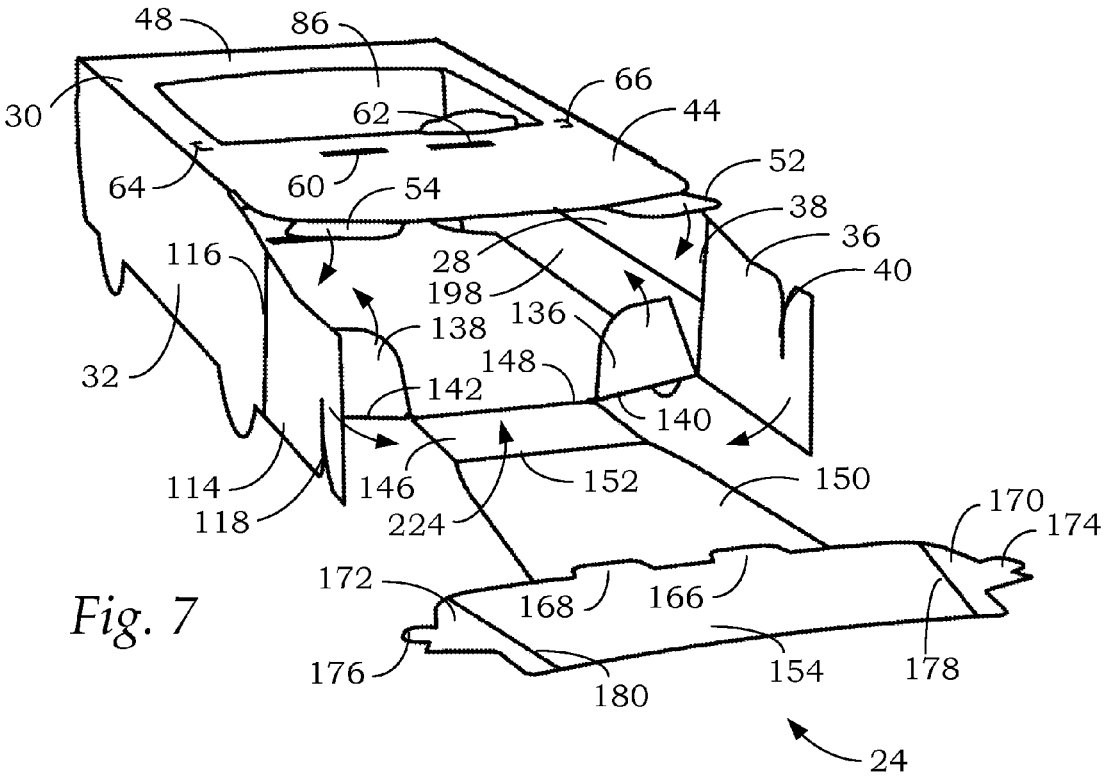
FIG. 7 is a front perspective view of FIG. 6, with first and second side tabs extending forwardly and a grill panel, upper front hood panel and windshield panel extending forwardly.
Figure 8:
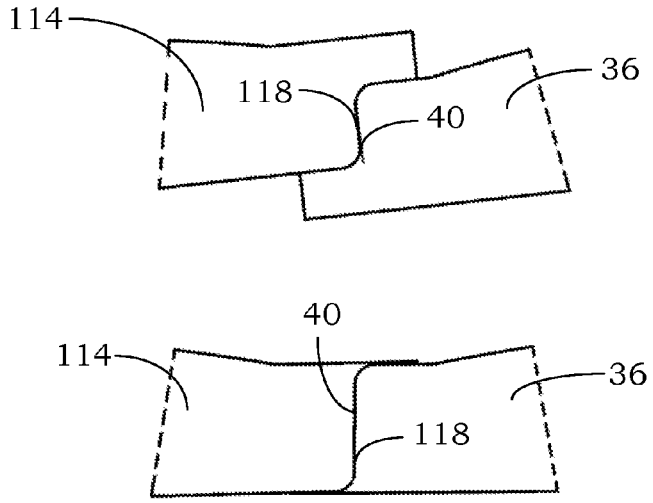
FIG. 8 is a partial sequential view of the first and second side tabs of FIG. 7 being secured together.
Figure 9:
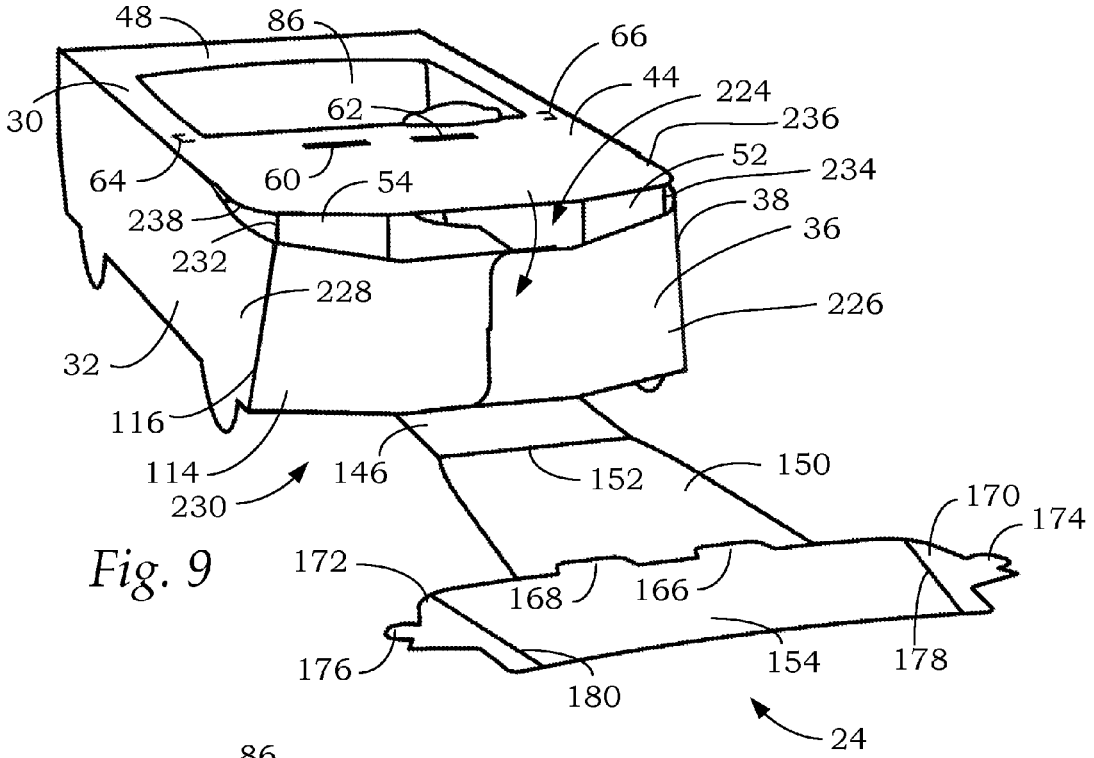
FIG. 9 is the front perspective view of FIG. 7, with the first and second side tabs shown secured together and enclosing the front of the vehicle and the first and second lower front hood tabs folded down behind the first and second side tabs.
Figure 10:
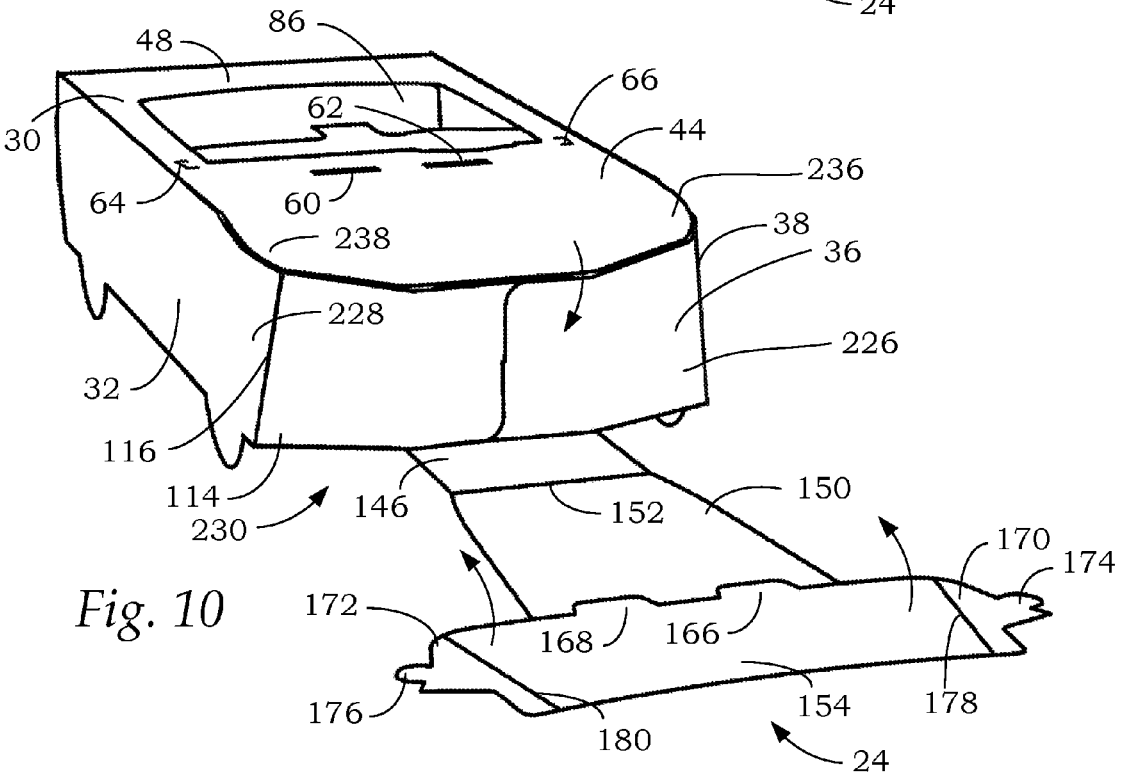
FIG. 10 is the front perspective view of FIG. 9, with the lower hood panel closed over the front of the vehicle.

Referring to FIGS. 4-6, assembly of the rear end 26 of the vehicle 22 is illustrated. The upper rear flap 50 is folded downwardly along fold line 94, the lower rear flap 186 is folded upwardly along fold lines 188, 190 and 192, and lower rear panel 182 is folded upwardly along fold line 184. Tabs 96 and 98 are inserted into slots 196 and 194 respectively. Wings 214 and 216 lock tab 96 in slot 196, and wings 218 and 220 lock tab 98 in slot 194 to present a rear end panel 222 enclosing the rear end 26 of the vehicle 22. The upper portion of rear end panel 222 is generally planar, while lower portion may be planar or have a slight curvature presenting an aesthetically pleasing rear view of the vehicle 22.

The interior portion of the vehicle 22 is configured by folding dash panel 72 downwardly into the interior space along fold lines 74 and 75. Because the fold line 88 is slightly curved, and the length of interior portion rear panel 86 is slightly longer than the depth of the interior space, when the interior portion rear panel 86 is folded along fold line 88 downwardly into the interior space, the rear deck panel 48 is given a slight curvature above the plane of the upper panel 30 presenting an aesthetically pleasing view of the vehicle 22.

Referring to FIGS. 7-13, assembly of the front end 24 of the vehicle 22 is illustrated. Front tabs 136 and 138 are folded upwardly along fold lines 140 and 142 into a front opening 224. Next, the engaging slit 40 of first side tab 36 mates with engaging slit 118 of second side tab 114 to enclose the front opening 224 and are under a slight tension by pulling the first side panel 28 and the second side panel 32 inwardly toward each other to create a first curved front corner 226 and a second curved front corner 228. Because fold lines 140 and 142 are angled inwardly, the first 36 and second 114 side tabs follow an arcuate curve to present a curved front end panel 230. Next, the first and second lower hood tabs 52 and 54 are folded along fold lines 56 and 58 respectively and lower hood panel 44 is folded downwardly enclosing the front opening 224. The first and second lower hood panel tabs 52 and 54 slip behind second side tab 114 and first side tab 36 respectively. An outside edge 232 of first lower hood panel tab 52 engages the inside corner along fold line 116 between second side panel 32 and second side tab 116. An outside edge 234 of second lower hood panel tab 54 engages the inside corner along fold line 38 between first side panel 28 and first side tab 36.

First 236 and second 238 corners of the lower hood panel 44 overlap the upper edges of first and second curved front corners 226 and 228 respectively to prevent the lower hood panel 44 from collapsing into the front opening 224 behind the curved front end panel 230. The combination of the tension exerted by the first and second side tabs 36 and 114, the inward curvature of the first and second curved front corners 226 and 228, the engagement of the outside edges 232 and 234 of first and second lower hood panel tabs 52 and 54 respectively with fold lines 116 and 226, stabilize the lower hood panel 44 and result in the lower hood panel having a slight curvature toward the front 24 of the vehicle 22.

Next, the grill panel 146 is folded upwardly along fold line 148 until it is generally perpendicular to the base panel 130 and seam between the first and second side tabs 36 and 114. Upper hood panel 150 is folded downwardly over lower hood panel 44 along fold line 152. Windshield panel 154 is folded along fold lines 156, 158 and 160 freeing first and second hood retention tabs 166 and 168 which extend downwardly to engage slots 62 and 60 respectively. First windshield wing 170 is folded along fold line 178 and tab 174 is received by slot 66. Second windshield wing 172 is folded along fold line 180 and tab 176 is received by slot 64. Tabs 174 and 176 received in slots 66 and 64 in combination with hood retention tabs 168 and 166 received in slots 60 and 62 create a slight tension in upper hood panel 150 to present a surface curving from the windshield panel 154 to the front end 24 to present an aesthetically pleasing front view of the vehicle 22.

Figure 17:
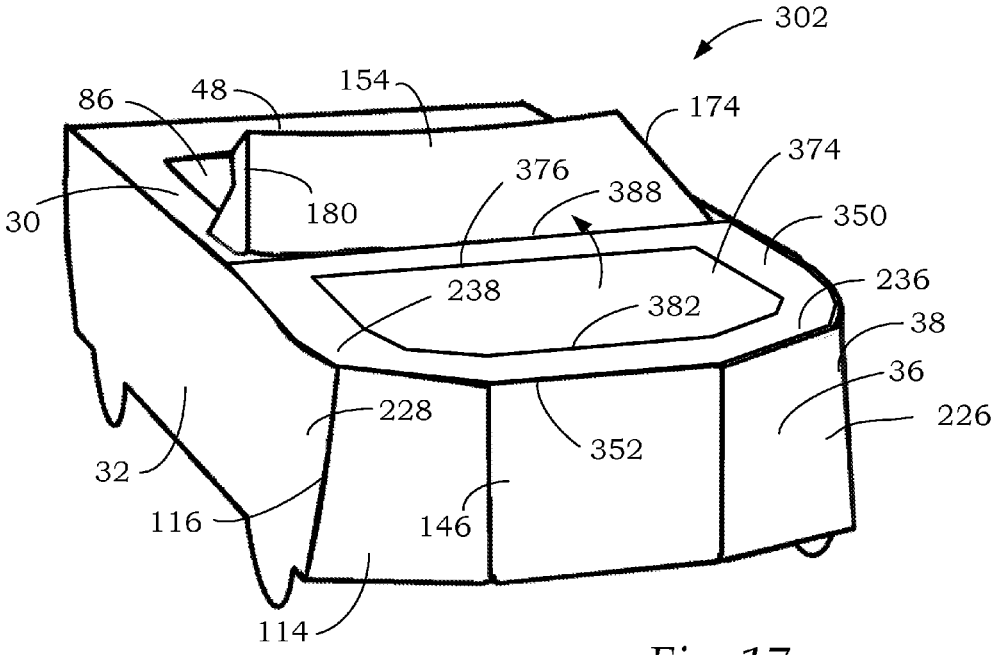
FIG. 17 is the front perspective view of FIG. 16, with the upper hood panel folded over the lower front hood panel and upper hood panel first and second tabs engaging lower front hood panel slots to secure the upper hood panel in place and the first and second wing tabs of the windshield engaging tabs in the upper panel to windshield panel in place.
Figure 18:
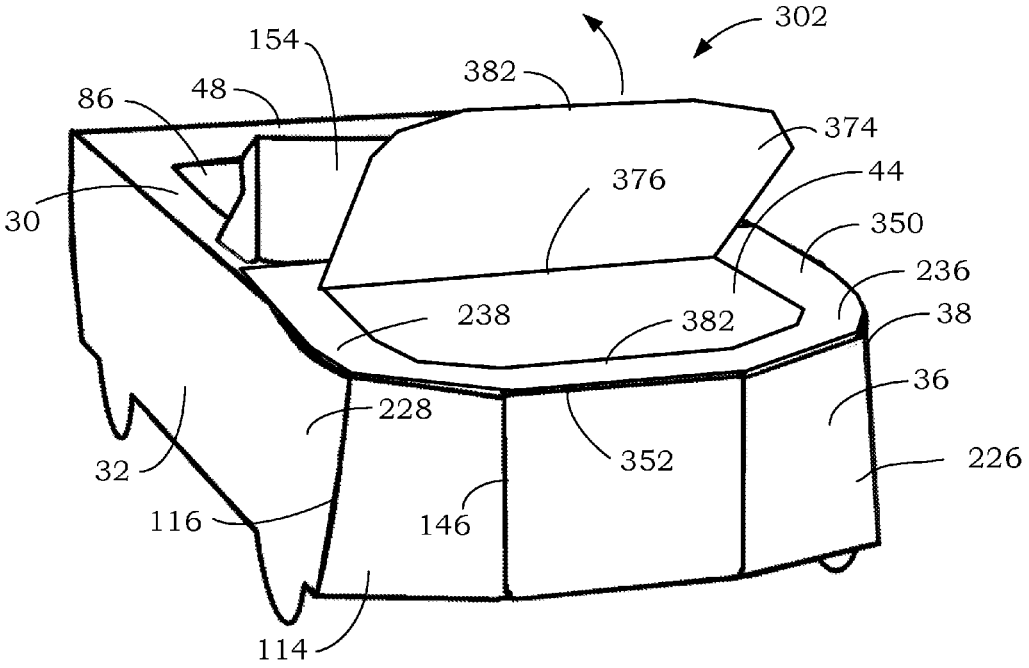
FIG. 18 is the front perspective view of FIG. 17, with the hood panel of the upper hood panel raised to expose the upper surface of the lower hood panel.

Referring to FIGS. 14-18, a sequence of steps for an alternate embodiment of the present invention is illustrated and shows a flat piece of sheet material 300 (FIG. 14) which, after the assembly operation is complete, becomes an assembled vehicle 302 (FIG. 17). As shown and described herein, the vehicle 302 takes the form of a modern vehicle car but could take any desired form. The sheet 300 is paperboard or a similar semi-rigid material capable of retaining fold lines and die cuts so that tabs and openings are formed upon removal of the cutout portions. A suitable material is 18-point white C1S SBS stock or a thin plastic material capable of retaining fold lines and being folded to a desired configuration. As is evident from FIG. 14, in its initially unassembled state, the sheet 302 is planar and flat having a first or front end 304 and a second or rear end 26.

Figure 14:
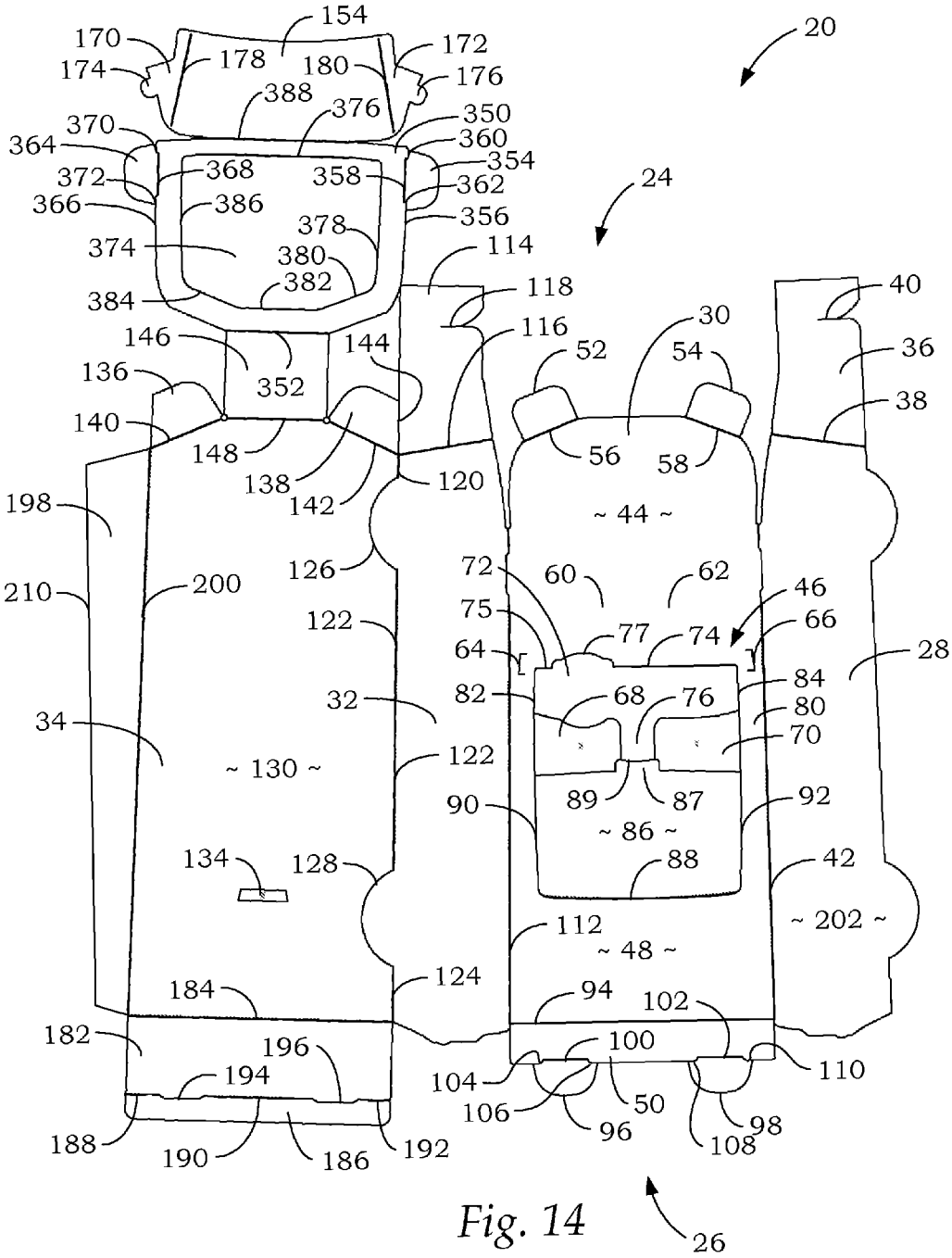
FIG. 14 is a top plan view of piece of flat sheet material having fold and perforation lines thereon, from which a carton or tray is formed in accordance with another embodiment of the present invention.
Figure 15:
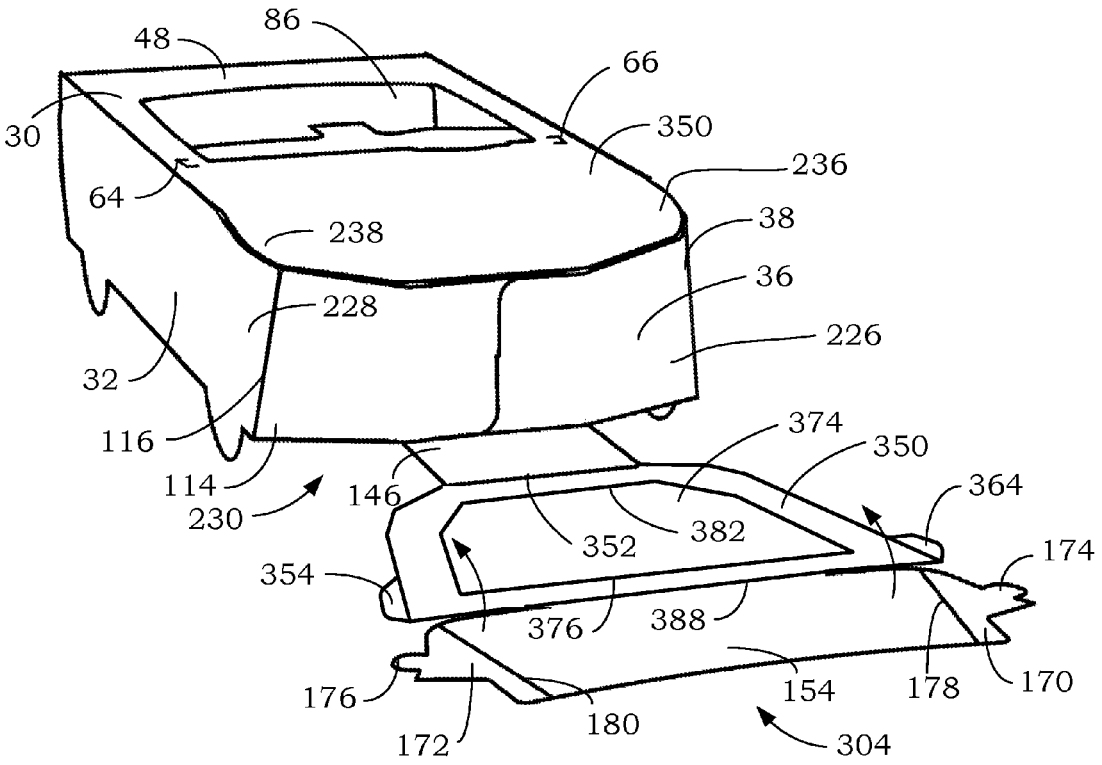
FIG. 15 is the front perspective view of FIG. 14 shown with the rear portion assembled, with the lower hood panel closed over the front of the vehicle and a grill panel, upper front hood panel and windshield flap extending forwardly.
Figure 16:
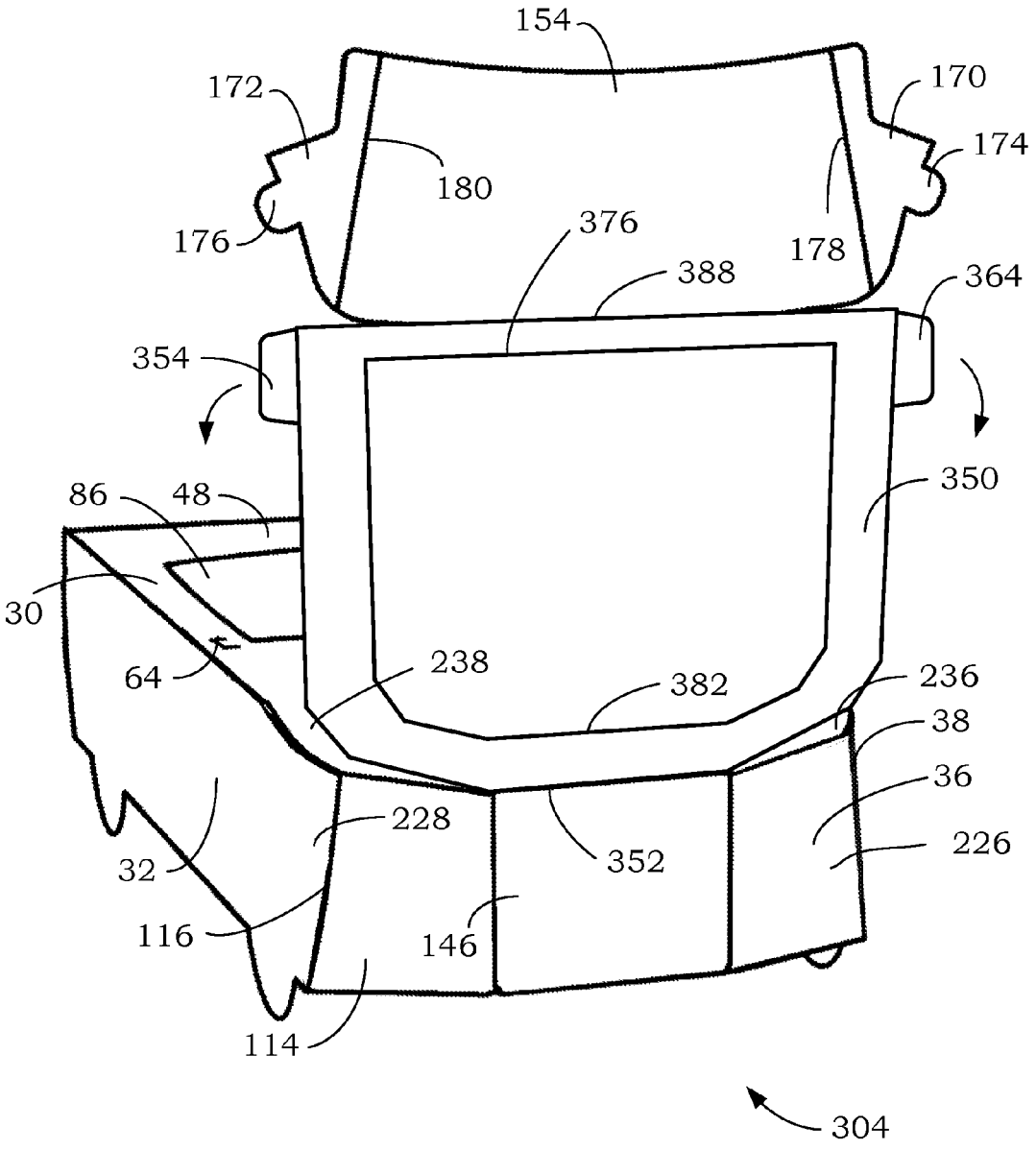
FIG. 16 is the front perspective view of FIG. 15, with the grill panel folded upwardly over the first and second side tabs.

FIG. 14 shows that the sheet 300 has a number of fold lines and perforation lines therein, the purpose of which will be described below. Additionally, the sheet stock from which the vehicle 302 is formed is die cut to provide the perimeter configuration shown. Many of the features described with respect to FIGS. 1-13 above are substantially the same as the features for FIGS. 14-18, and thus the same reference number will be used. The sheet 300 includes a first side panel 28, an upper panel 30, a second side panel 32, and a bottom panel 34. The first side panel 28 includes a first side tab 36 extending forwardly from the first side panel 28 separated by fold line 38. The first side tab 36 includes an engaging slit 40.

The first side panel 28 transitions to upper panel 30 along fold line 42. Upper panel 30 includes a lower hood panel 44, an interior portion 46, a rear deck panel 48, and an upper rear flap 50. The lower hood panel 44 includes first 52 and second 54 lower hood tabs extending forwardly from lower hood panel 44 along fold lines 56 and 58, respectively, and first and second hood retaining slots 320 and 322, respectively, which are cut generally parallel to the fold lines 42 and 112. First 64 and second 66 windshield slots are cut generally parallel to the fold line 42 on opposite sides of the upper panel 30 generally at the transition between the lower hood panel 44 and the interior portion 46.

The interior portion 46 of upper panel 30 includes first and second cutouts 68 and 70, a dash panel 72, which extends from the rear of lower hood panel 44 along fold line 74. Dash panel 74 includes a console 76 extending rearwardly from the dash panel 72 when the dash panel 72 is not folded, and extending downwardly from the dash panel 72 when the dash panel is folded along fold lines 74 and 75 and separates from lower hood panel along die cut 77 to form the front interior of the vehicle 22. The dash panel 72 is free from interior panel first 78 and second 80 upper sides along die cuts 82 and 84.

An interior portion rear panel 86 extends forwardly from the rear deck panel 48 along fold line 88, and is free from interior panel first 78 and second 80 upper sides along die cuts 90 and 92. The interior portion rear panel 86 includes a tab 87 extending forwardly and separated from tab 76 extending rearwardly from the dash panel 76 by die cut 89. The upper rear flap 50 extends rearwardly from the rear deck panel 48 along fold line 94. A first 96 and second 98 tab extends rearwardly from rear flap 50 along fold lines 100 and 102 respectively. First tab 96 is die cut on opposite sides 104 and 106 as is second tab 98 on opposite sides 108 and 110, which presents wings on opposite sides of the tabs 96 and 98 to help lock the tabs 96 and 98 into their respective engaging slots disclosed herein below.

The upper panel 30 transitions to the second side panel 32 along fold line 112. The second side panel 32 includes a second side tab extending forwardly from the second side panel 32 separated by fold line 116. The second side tab 114 includes an engaging slit 118 for engaging and locking to the engaging slit 40 of the first side tab 36.

The second side panel 32 transitions to the bottom panel 34 along fold lines 120, 122 and 124, and die cut second front wheel 126 and second rear wheel 128. The bottom panel 34 includes a base panel 130 with a first cutout 134 for receiving the tab 87 of interior portion rear panel 86, which secures the interior portion rear panel 86 in place when folded along fold line 88 into the interior space. The fold line 88 is slightly curved, and the length of interior portion rear panel 86 is slightly longer than the depth of the interior space The bottom panel 34 includes first 136 and second 138 front tabs, which transition along fold lines 140 and 142, respectfully from bottom panel 34 at the front end 24. Second front tab 138 is separated from second side tab 114 along die cut 144. A grill panel 146 transitions along fold line 148 from base panel 130 to an upper hood panel 350 along fold line 352. The upper hood panel 350 includes a first tab 354 extending from a first edge 356 of upper hood panel 350 along fold line 358. The first tab 354 is die cut on opposite sides 360 and 362. A second tab 364 extending from a second edge 366 of upper hood panel 350 along fold line 368. The second tab 364 is die cut on opposite sides 370 and 372. A raisable hood panel 374 extends from the upper hood panel 350 along fold line 376 and is die cut along edges 378, 380, 382, 384 and 386.

A windshield panel 154 extends from upper hood panel 350 along fold line 388. The windshield panel 154 includes first 170 and second 172 wings which each include a tab 174 and 176, respectively, for engaging slots 64 and 66, respectively, to secure the windshield panel 154 in position to the upper panel 30. The first wing 170 extends from the windshield panel 154 along fold line 178, and the second wing 172 extends from the windshield panel 154 along fold line 180.

A lower rear panel 182 transitions from base panel 130 along fold line 184. The lower rear panel 182 transitions to a lower rear flap 186 along fold lines 188, 190 and 192, and die cuts 194 and 196 presenting slots for receiving tabs 96 and 98. An adhesive tab 198 extends from base panel 130 along fold line 200.

Assembly of the rear end of the vehicle 302 and interior portion is the same as described above for the vehicle 22, so it will not be repeated here.

Referring to FIGS. 15-18, assembly of the front end 304 of the vehicle 302 is illustrated. Assembly of the front end 304 is substantially the same as the assembly of the front end 24 of vehicle 22, described in detail above and shown in detail in FIGS. 7-10, so this description will not be repeated for front end 304.

Next, the grill panel 146 is folded upwardly along fold line 148 until it is generally perpendicular to the base panel 130 and seam between the first and second side tabs 36 and 114. Upper hood panel 350 is folded downwardly over lower hood panel 44 along fold line 352. First and second tabs 354 and 364 are folded downwardly along fold lines 358 and 368 respectively and received in slots 322 and 320 respectively. Windshield panel 154 is folded forwardly along fold line 388. First windshield wing 170 is folded along fold line 178 and tab 174 is received by slot 66. Second windshield wing 172 is folded along fold line 180 and tab 176 is received by slot 64. Tabs 174 and 176 received in slots 66 and 64 in combination with tabs 354 and 364 received in slots 322 and 322 create a slight tension in upper hood panel 150 to present a surface curving from the windshield panel 154 to the front end 24 to present an aesthetically pleasing front view of the vehicle 22. The raisable hood panel 374 may be folded upwardly from the upper hood panel 350 along fold line 376 to reveal the upper surface of lower hood panel 44.

It is to be understood that while certain now preferred forms of this invention have been illustrated and described, it is not limited thereto except insofar as such limitations are included in the following claims.

Having thus described the invention, what is claimed as new and desired to be secured by Letters Patent is as follows:

1. A carton with a vehicle configuration, comprising:

an upper panel presenting a first hood panel, an interior portion and a rear deck panel;

a first side panel extending laterally from said upper panel along a first longitudinal fold line;

a second side panel extending laterally from said upper panel along a second longitudinal fold line;

a bottom panel presenting a grill panel, a second hood panel, a windshield panel and a lower rear panel, said bottom panel extending laterally from said second side panel along a third longitudinal fold line; and a tab panel extending laterally from said bottom panel along a fourth longitudinal fold line;

wherein said first side panel is folded upwardly along said first longitudinal fold line;

wherein said upper panel is folded upwardly along said second longitudinal fold line;

wherein said second side panel is folded upwardly along said third longitudinal fold line;

wherein said tab panel is folded upwardly along said fourth longitudinal fold line to engage said first side panel and present an interior area;

wherein said rear deck panel is folded downwardly and said lower rear panel is folded upwardly to engage said rear deck panel to present a rear end of said carton;

wherein said grill panel is folded upwardly from said bottom panel, said second hood panel is folded rearwardly from said grill panel to present a front end of said carton;

wherein said windshield panel is folded upwardly from said second hood panel and coupled to said upper panel;

wherein said first side panel includes a first side panel tab having a first engaging slit, said second side panel includes a second side panel tab having a second engaging slit, said first and second side panel tabs folded forwardly and said first engaging slit engaging said second engaging slit to enclose said front end of said vehicle and;

wherein said upper panel includes a first pair of spaced apart tabs extending forwardly, said bottom panel includes a second pair of spaced apart tabs extending forwardly, wherein said first pair of spaced apart tabs are folded downwardly, wherein said second pair of spaced apart tabs are folded upwardly, and wherein said first pair of spaced apart tabs and second pair of spaced apart tabs are positioned behind said first and second side panel tabs to support said front end of said vehicle.

2. The carton of claim 1 wherein said carton comprises a semi-rigid material.

3. The carton of claim 1 wherein said first and second side panels each include a front and rear wheel cutout.

4. The carton of claim 1 wherein said first hood panel extends over a first upper edge of said first side panel tab and a second upper edge of said second side panel tab.

5. The carton of claim 1 wherein said grill panel folds over said first side panel tab and said second side panel tab.

6. The carton of claim 1 wherein said second hood panel folds over said first hood panel.

7. The carton of claim 1 wherein said second hood panel includes a raisable hood panel having a closed position and a raised position revealing said first hood panel.

8. A carton with a vehicle configuration, comprising:

an upper panel presenting a first hood panel, an interior portion and a rear deck panel;

a first side panel extending laterally from said upper panel along a first longitudinal fold line;

a second side panel extending laterally from said upper panel along a second longitudinal fold line;

a bottom panel presenting a grill panel, a second hood panel, a windshield panel and a lower rear panel, said bottom panel extending laterally from said second side panel along a third longitudinal fold line; and a tab panel extending laterally from said bottom panel along a fourth longitudinal fold line;

wherein said first side panel is folded upwardly along said first longitudinal fold line;

wherein said upper panel is folded upwardly along said second longitudinal fold line;

wherein said second side panel is folded upwardly along said third longitudinal fold line;

wherein said tab panel is folded upwardly along said fourth longitudinal fold line to engage said first side panel and present an interior area;

wherein said rear deck panel is folded downwardly and said lower rear panel is folded upwardly to engage said rear deck panel to present a rear end of said carton;

wherein said grill panel is folded upwardly from said bottom panel, said second hood panel is folded rearwardly from said grill panel to present a front end of said carton; and wherein said windshield panel is folded upwardly from said second hood panel and coupled to said upper panel; and wherein said interior portion includes a dash panel extending rearwardly from said first hood panel, and an interior rear panel extending forwardly from said rear deck panel; wherein said dash panel is folded downwardly and said interior rear panel is folded downwardly to present a cabin.

9. A carton comprising:

a first side panel having a first side panel tab extending forwardly along a first side panel fold line, said first side panel tab having a first engaging slit;

an upper panel connected to said first side panel along a first longitudinal fold line; said upper panel having a lower hood panel, an interior portion, a rear deck, an upper rear flap, and first and second windshield slots cut generally parallel to said first longitudinal fold line on opposite sides of said upper panel at a transition between said lower hood panel and said interior panel;

said lower hood panel having a pair of spaced apart tabs extending forwardly, and first and second hood retention slots cut generally parallel to said front end;

a second side panel connected to said upper panel along a second longitudinal fold line; said second side panel having a second side panel tab extending forwardly along a second side panel fold line, said second side panel tab having a second engaging slit configured to receive said first side panel tab first engaging slit;

a bottom panel connected to said second side panel along a third longitudinal fold line and having a base panel; said bottom panel having a base panel, a pair of spaced apart tabs extending forwardly, a grill panel extending forwardly from said base panel along a first transverse fold line, a upper hood panel extending forwardly from said grill panel along a second transverse fold line, a windshield panel extending from said upper hood panel along a third transverse fold line, first and second hood retention tabs configured to be received in said first and second hood retention slots, first and second wing tabs extending from opposite lateral sides of said windshield panel and configured to be received in said first and second windshield slots, and a lower rear panel extending rearwardly from said base panel along a fourth transverse fold line, and a tab panel connected to said bottom panel along a fourth longitudinal fold line.

10. The carton of claim 9 wherein said carton comprises a semi-rigid material.

11. The carton of claim 9 wherein said first and second side panels each include a front and rear wheel cutout.

12. The carton of claim 9 wherein said first and second side panel tabs enclose said front end of said vehicle.

13. The carton of claim 12 wherein said first hood panel extends over a first upper edge of said first side panel tab and a second upper edge of said second side panel tab.

14. The carton of claim 12 wherein said grill panel folds over said first side panel tab and said second side panel tab.

15. The carton of claim 12 wherein said upper panel includes a first pair of spaced apart tabs extending forwardly, said bottom panel includes a second pair of spaced apart tabs extending forwardly, wherein said first pair of spaced apart tabs are folded downwardly, wherein said second pair of spaced apart tabs are folded upwardly, and wherein said first pair of spaced apart tabs and second pair of spaced apart tabs are positioned behind said first and second side panel tabs to support said front end of said vehicle.

16. The carton of claim 9 wherein said upper hood panel folds over said lower hood panel.

17. The carton of claim 9 wherein said upper hood panel includes a raisable hood panel having a closed position and a raised position revealing said lower hood panel.

18. The carton of claim 9 wherein said interior portion includes a dash panel extending rearwardly from said first hood panel, and an interior rear panel extending forwardly from said rear deck panel; wherein said dash panel is folded downwardly and said interior rear panel is folded downwardly to present a cabin.

19. A method of folding a carton into a vehicle configuration, comprising the steps of:

folding a first side panel upwardly along a first longitudinal fold line between said first side panel and an upper panel;

folding said upper panel upwardly along a second longitudinal fold line between said upper panel and a second side panel;

folding said second side panel upwardly along said third longitudinal fold line between said second side panel and a bottom panel;

folding a tab panel upwardly along said fourth longitudinal fold line between said tab panel and said bottom panel;

coupling said tab panel to said first side panel to present an interior area;

folding a rear deck panel downwardly from a rear portion of said upper panel;

folding a lower rear panel upwardly from a rear portion of said bottom panel to engage said rear deck panel to present a rear end of said carton;

folding a first pair of spaced apart tabs extending forwardly from said upper panel downwardly, folding a second pair of spaced apart tabs extending forwardly from said bottom panel upwardly, and wherein said first pair of spaced apart tabs and second pair of spaced apart tabs are positioned behind said first and second side panel tabs to support said front end of said vehicle;

folding a first side panel tab forwardly and inwardly from said first side panel and folding a second side panel tab forwardly and inwardly from said second side panel, and coupling said first side panel tab with said second side panel tab to enclose said front end of said carton;

folding a grill panel upwardly from said bottom panel to present a front end of said carton;

folding a second hood panel rearwardly from said grill panel and over said first hood panel;

folding a windshield panel upwardly from said second hood panel; and coupling said windshield panel to said upper panel.

20. The method of claim 19 wherein said carton comprises a semi-rigid material.

21. The method of claim 19 wherein said first and second side panels each include a front and rear wheel cutout.

22. The method of claim 19 wherein said first hood panel extends over a first upper edge of said first side panel tab and a second upper edge of said second side panel tab.

23. The method of claim 19 wherein said grill panel folds over said first side panel tab and said second side panel tab.

24. The method of claim 19 wherein said upper hood panel folds over said lower hood panel.

25. The method of claim 19 wherein said upper hood panel includes a raisable hood panel having a closed position and a raised position revealing said lower hood panel.

26. A method of folding a carton into a vehicle configuration, comprising the steps of:

folding a first side panel upwardly along a first longitudinal fold line between said first side panel and an upper panel;

folding said upper panel upwardly along a second longitudinal fold line between said upper panel and a second side panel;

folding said second side panel upwardly along said third longitudinal fold line between said second side panel and a bottom panel;

folding a tab panel upwardly along said fourth longitudinal fold line between said tab panel and said bottom panel;

coupling said tab panel to said first side panel to present an interior area;

folding a rear deck panel downwardly from a rear portion of said upper panel;

folding a lower rear panel upwardly from a rear portion of said bottom panel to engage said rear deck panel to present a rear end of said carton;

folding a grill panel upwardly from said bottom panel to present a front end of said carton;

folding a second hood panel rearwardly from said grill panel and over said first hood panel;

folding a windshield panel upwardly from said second hood panel; and coupling said windshield panel to said upper panel;

wherein said interior portion includes a dash panel extending rearwardly from said first hood panel, and an interior rear panel extending forwardly from said rear deck panel; wherein said dash panel is folded downwardly and said interior rear panel is folded downwardly to present a cabin.

* * * * *